US007556019B2

(12) United States Patent
Jury et al.

(10) Patent No.: US 7,556,019 B2
(45) Date of Patent: Jul. 7, 2009

(54) INTAKE MANIFOLD REGULATORS FOR INTERNAL COMBUSTION ENGINES

(75) Inventors: Brett Jury, Whitefish Bay, WI (US); James J. Dehn, Brookfield, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 0 days.

(21) Appl. No.: 11/639,764

(22) Filed: Dec. 15, 2006

(65) Prior Publication Data

US 2008/0141969 A1 Jun. 19, 2008

(51) Int. Cl.
*F02M 35/10* (2006.01)

(52) U.S. Cl. ..... 123/391; 123/184.56

(58) Field of Classification Search ..... 123/184.53, 123/184.56, 336, 337, 306, 65 P, 65 PD, 123/65 V, 402–405, 389, 391
See application file for complete search history.

(56) References Cited

U.S. PATENT DOCUMENTS

| | | | |
|---|---|---|---|
| 3,937,768 | A | 2/1976 | Bier et al. |
| 3,965,873 | A | 6/1976 | Konomi et al. |
| 3,994,998 | A | 11/1976 | Mineck |
| 4,020,805 | A | 5/1977 | Konomi et al. |
| 4,153,029 | A | 5/1979 | Ikegaya |
| 4,193,947 | A | 3/1980 | Bugamelli |
| 4,231,383 | A | 11/1980 | Eversole et al. |
| 4,274,368 | A | 6/1981 | Shaffer |
| 4,364,364 | A | 12/1982 | Subramaniam |
| 4,384,563 | A | 5/1983 | Siefer et al. |
| 4,426,980 | A | 1/1984 | Eisele et al. |
| 4,487,185 | A | 12/1984 | Yokoyama et al. |
| 4,492,212 | A | 1/1985 | Dooley |
| 4,704,996 | A | 11/1987 | Morikawa |
| 4,760,703 | A | 8/1988 | Minami et al. |
| 4,805,573 | A | 2/1989 | Macfarlane et al. |
| 4,864,991 | A | 9/1989 | Snyder et al. |
| 4,890,586 | A | 1/1990 | Fujii et al. |

(Continued)

FOREIGN PATENT DOCUMENTS

| | | |
|---|---|---|
| FR | 664.130 | 4/1929 |

(Continued)

OTHER PUBLICATIONS

Bonsor, Kevin and Karim Nice, "How NASCAR Safety Works", website: http://auto.howstuffworks.com/nascar-safety.htm/printable, printed on Aug. 27, 2004, p. 5 of 10.

*Primary Examiner*—Hai H Huynh
(74) *Attorney, Agent, or Firm*—Michael Best & Friedrich LLP

(57) ABSTRACT

The present invention provides an internal combustion engine including an engine housing, a crankshaft rotatably supported in the engine housing, a cylinder, a piston movable within the cylinder, a combustion chamber in fluid communication with the cylinder, a fuel system configured to provide fuel to the combustion chamber, an intake passageway configured to provide a fluid to the combustion chamber, and a first regulator at least partially positioned in the intake passageway. The first regulator is selectable from a plurality of regulators. The engine also includes a coupling device configured to maintain the first regulator in the intake passageway. The first regulator is configured to be removed and replaced by a second regulator from the plurality of regulators without disassembly of the intake passageway.

32 Claims, 15 Drawing Sheets

U.S. PATENT DOCUMENTS

| | | | | |
|---|---|---|---|---|
| 4,900,343 | A | 2/1990 | Minami et al. | |
| 4,928,638 | A | 5/1990 | Overbeck | |
| 5,020,973 | A | 6/1991 | Lammers | |
| 5,255,649 | A | 10/1993 | Isaka | |
| 5,715,781 | A | 2/1998 | Martinelli | |
| 5,749,342 | A | 5/1998 | Chao | |
| 5,924,398 | A | 7/1999 | Choi | |
| 5,924,698 | A | 7/1999 | Parkin | |
| 5,947,085 | A * | 9/1999 | Deal | 123/389 |
| 6,148,782 | A | 11/2000 | Fuesser | |
| 6,299,144 | B1 | 10/2001 | Salvisberg | |
| 6,332,442 | B1 | 12/2001 | Komada et al. | |
| 6,450,141 | B1 | 9/2002 | Sakuma | |
| 6,481,425 | B1 | 11/2002 | Lee | |
| 6,497,245 | B1 * | 12/2002 | Torii | 137/315.11 |
| 6,564,767 | B1 | 5/2003 | Reese | |
| 6,571,760 | B2 | 6/2003 | Kallander | |
| 6,748,915 | B2 | 6/2004 | Cole et al. | |
| 6,830,238 | B1 | 12/2004 | Kesselring | |
| 7,140,383 | B2 * | 11/2006 | Yamamoto et al. | 137/454.2 |
| 7,299,688 | B2 * | 11/2007 | Salvisberg | 73/117.3 |
| 2004/0107934 | A1 | 6/2004 | Bucknell et al. | |
| 2007/0079800 | A1 * | 4/2007 | Fornara et al. | 123/306 |
| 2007/0095323 | A1 * | 5/2007 | Salvisberg | 123/184.53 |
| 2007/0244624 | A1 | 10/2007 | Salvisberg | |

FOREIGN PATENT DOCUMENTS

| | | |
|---|---|---|
| GB | 359062 | 10/1931 |
| GB | 437020 | 10/1935 |
| JP | 3033428 | 2/1991 |

* cited by examiner

INTAKE MANIFOLD REGULATORS FOR INTERNAL COMBUSTION ENGINES

FIELD OF THE INVENTION

This invention relates generally to internal combustion engines, and more particularly to intake manifold regulators for internal combustion engines.

BACKGROUND OF THE INVENTION

Regulators are often used to reduce the power output of an internal combustion engine. When used in combination with carbureted engines, such regulators are configured to not be easily removable.

SUMMARY OF THE INVENTION

The present invention provides, in one aspect, an engine system configured to provide a plurality of engines having different power outputs at the same selected speed. The engine system includes a first engine having a first power output at the selected speed. The first engine includes a first engine housing, a first crankshaft rotatably supported in the first engine housing, a first cylinder, a first piston movable within the first cylinder, a first combustion chamber in fluid communication with the first cylinder, a first fuel system configured to provide fuel to the first combustion chamber, a first passageway configured to provide a fluid (e.g., air, fuel, or an air/fuel mixture) to the first combustion chamber, and a first regulator at least partially positioned in the first passageway. The first regulator is selected such that the first engine operates at the first power output at the selected speed. The first engine also includes a first coupling device configured to maintain the first regulator in the first passageway. The first coupling device is also configured to enable removal of the first regulator without disassembly of the first passageway. The engine system also includes a second engine having a second power output at the selected speed different from the first power output. The second engine includes a second engine housing, a second crankshaft rotatably supported in the second engine housing, a second cylinder, a second piston movable within the second cylinder, a second combustion chamber in fluid communication with the second cylinder, a second fuel system configured to provide fuel to the second combustion chamber, a second passageway configured to provide a fluid (e.g., air, fuel, or an air/fuel mixture) to the second combustion chamber, and a second regulator at least partially positioned in the second passageway. The second regulator is selected such that the second engine operates at the second power output at the selected speed, with the second power output being different from the first power output. The second engine also includes a second coupling device configured to maintain the second regulator in the second passageway. The second coupling device is also configured to enable removal of the second regulator without disassembly of the second passageway.

Such an engine system may be used to manufacture engines, each engine having a distinct desired power output selectable from a range of power outputs, from a common engine configuration utilizing the same fuel calibration and the same fuel systems. For example, first and second production runs of engines, including substantially identical engine housings, crankshafts, cylinders, pistons, combustion chambers, fuel systems, and intake passageways may yield a first power output at a selected speed and a second power output (different than the first power output) at the selected speed, respectively, due to the differently-sized regulators chosen for the first and second production runs of engines. Therefore, costs relating to tooling, down time, and assembly line set-up changes to incorporate different crankshafts, camshafts, pistons, connecting rods, cylinder heads, or fuel systems to change the power output of the engines may be reduced. The engines may be pre-built and stored in inventory, with their respective regulators being added or changed later.

The present invention provides, in another aspect, an internal combustion engine including an engine housing, a crankshaft rotatably supported in the engine housing, a cylinder, a piston movable within the cylinder, a combustion chamber in fluid communication with the cylinder, a fuel system configured to provide fuel to the combustion chamber, an intake passageway configured to provide a fluid (e.g., air, fuel, or an air/fuel mixture) to the combustion chamber, and a first regulator at least partially positioned in the intake passageway. The first regulator is selectable from a plurality of regulators. The engine also includes a coupling device configured to maintain the first regulator in the intake passageway. The first regulator is configured to be removed and replaced by a second regulator from the plurality of regulators without disassembly of the intake passageway.

The present invention provides, in yet another aspect, a regulator adapted to be received within an aperture near an intake passageway in an internal combustion engine. The regulator includes a first portion configured to be exposed to an airflow in the intake passageway and selected such that the engine operates at a first power output at a selected speed when the first portion is exposed to the airflow, and a second portion configured to be received within the aperture and removably coupled to the engine without disassembly of the intake passageway.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
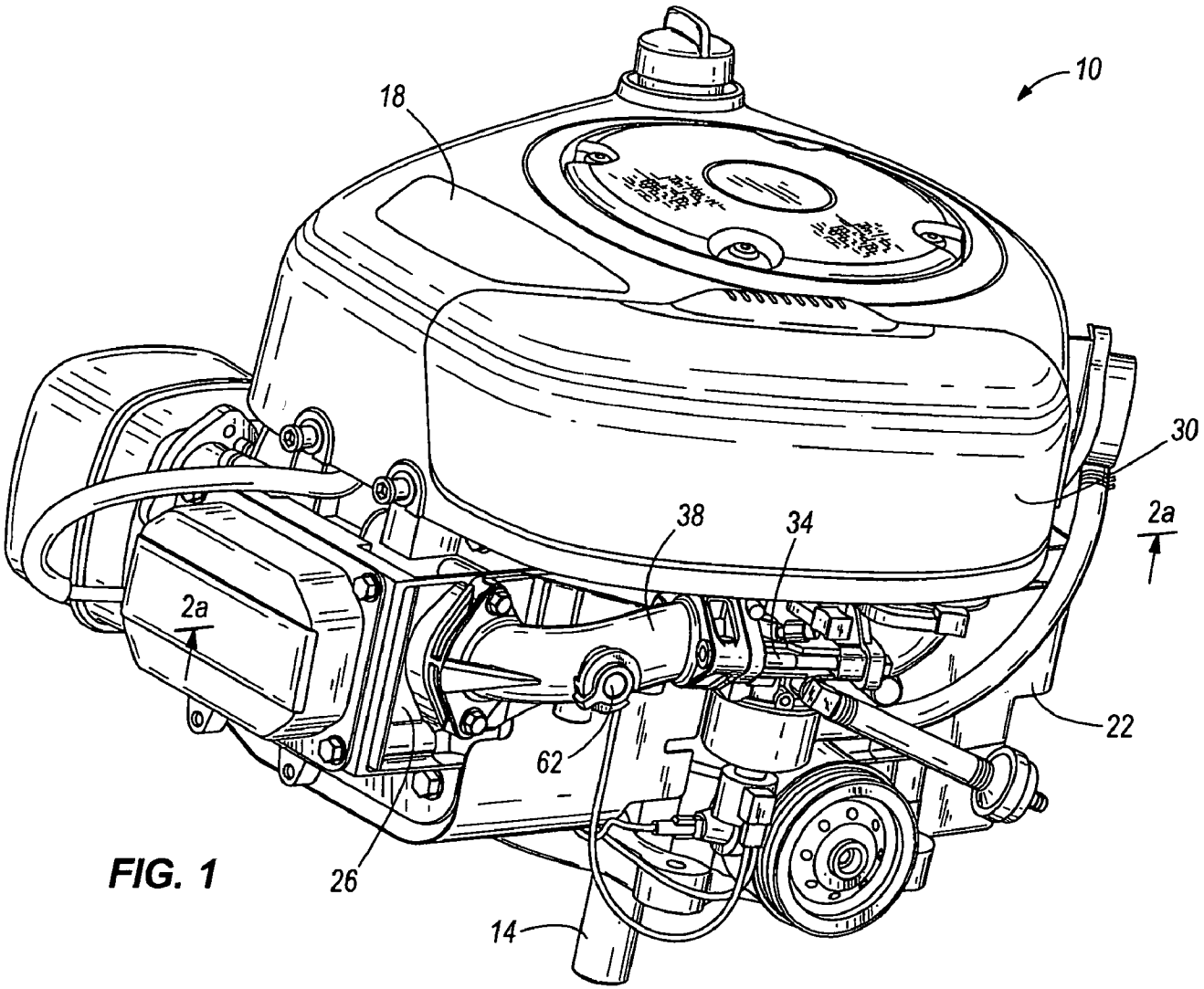
FIG. 1 is a perspective view of an internal combustion engine of the present invention.

FIG. 1 illustrates a small, air-cooled, four-stroke internal combustion engine 10 having a single cylinder 12 (see FIG. 2*a*) and a vertically-oriented crankshaft or output shaft 14. The engine 10 also includes a piston 15 coupled to the output shaft 14 by a connecting rod 17 for reciprocating movement in the cylinder 12, and a combustion chamber 16 in fluid communication with the cylinder 12. The engine 10 may be configured to operate, among other things, engine-driven outdoor power equipment (e.g., lawn mowers, lawn tractors, snow throwers, generators, pressure washers, etc.). When used in combination with a walk-behind lawn mower, for example, the engine 10 may be supported by a mower deck and the output shaft 14 may be coupled to a blade positioned beneath the mower deck. It should be understood that alternative constructions of the engine 10 may also include multiple-cylinder configurations or a horizontal output shaft configuration.

With continued reference to FIG. 1, the engine 10 also includes a blower housing 18 for providing a cooling airflow over the external components of the engine 10 (e.g., an outer housing or engine housing 22 and a cylinder head 26), an air cleaner 30 coupled to the blower housing 18 for providing a filtered airflow to the engine 10, a fuel system including a carburetor 34 that receives the filtered airflow from the air cleaner 30 and adds fuel to the filtered airflow to create a fuel/air mixture, and an intake manifold 38 coupled to the carburetor 34 for delivering the fuel/air mixture to the cylinder head 26. It should also be understood that the engine 10 may include any of a number of different configurations of blower housings for providing the cooling airflow over the external components of the engine and/or air cleaners for providing the filtered airflow to the engine 10.

Figure 3:
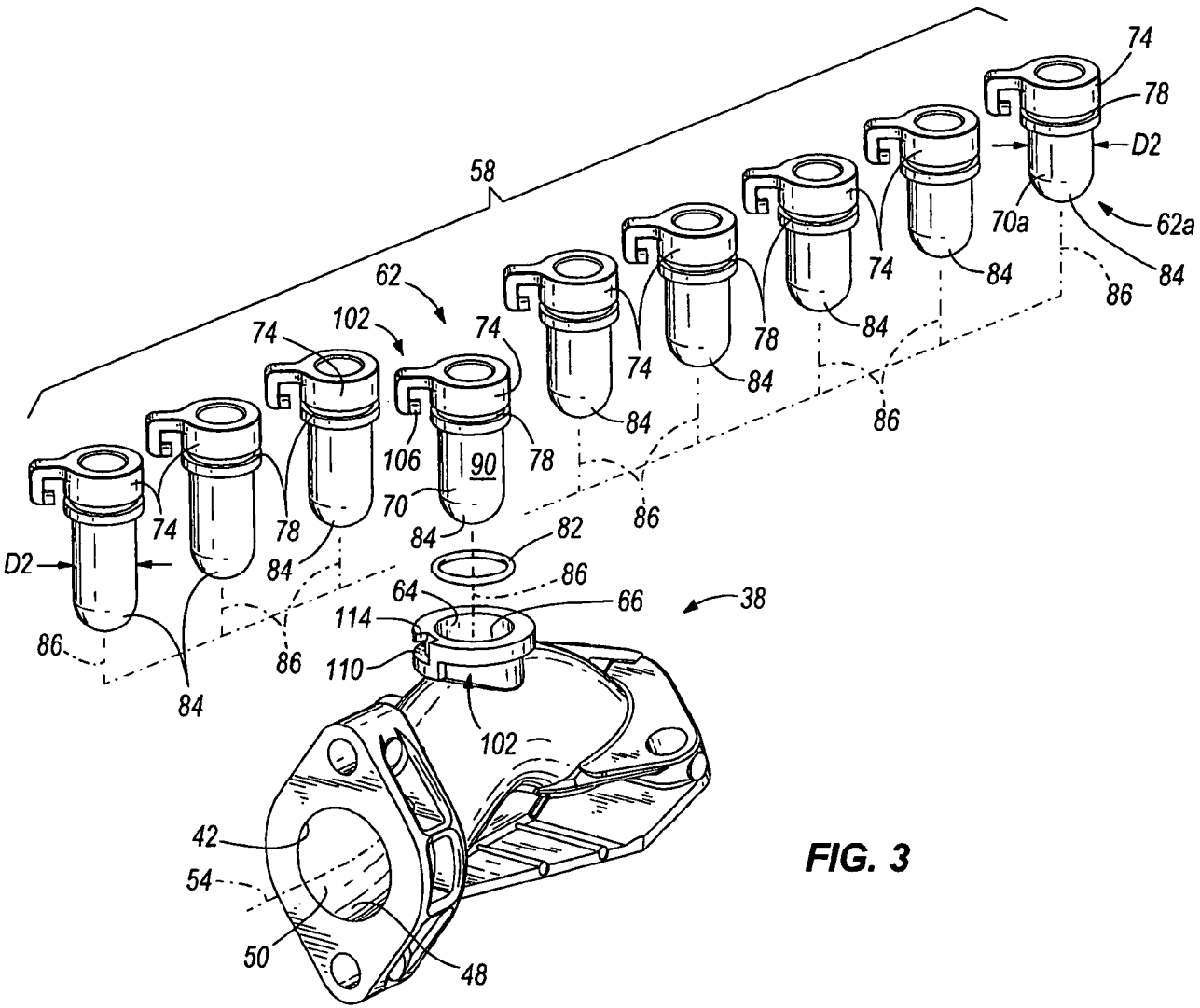
FIG. 3 is an exploded perspective view of a portion of the engine of FIG. 1, illustrating a first construction of an intake manifold and a first construction of a group or family of differently-sized intake manifold regulators.
Figure 4:
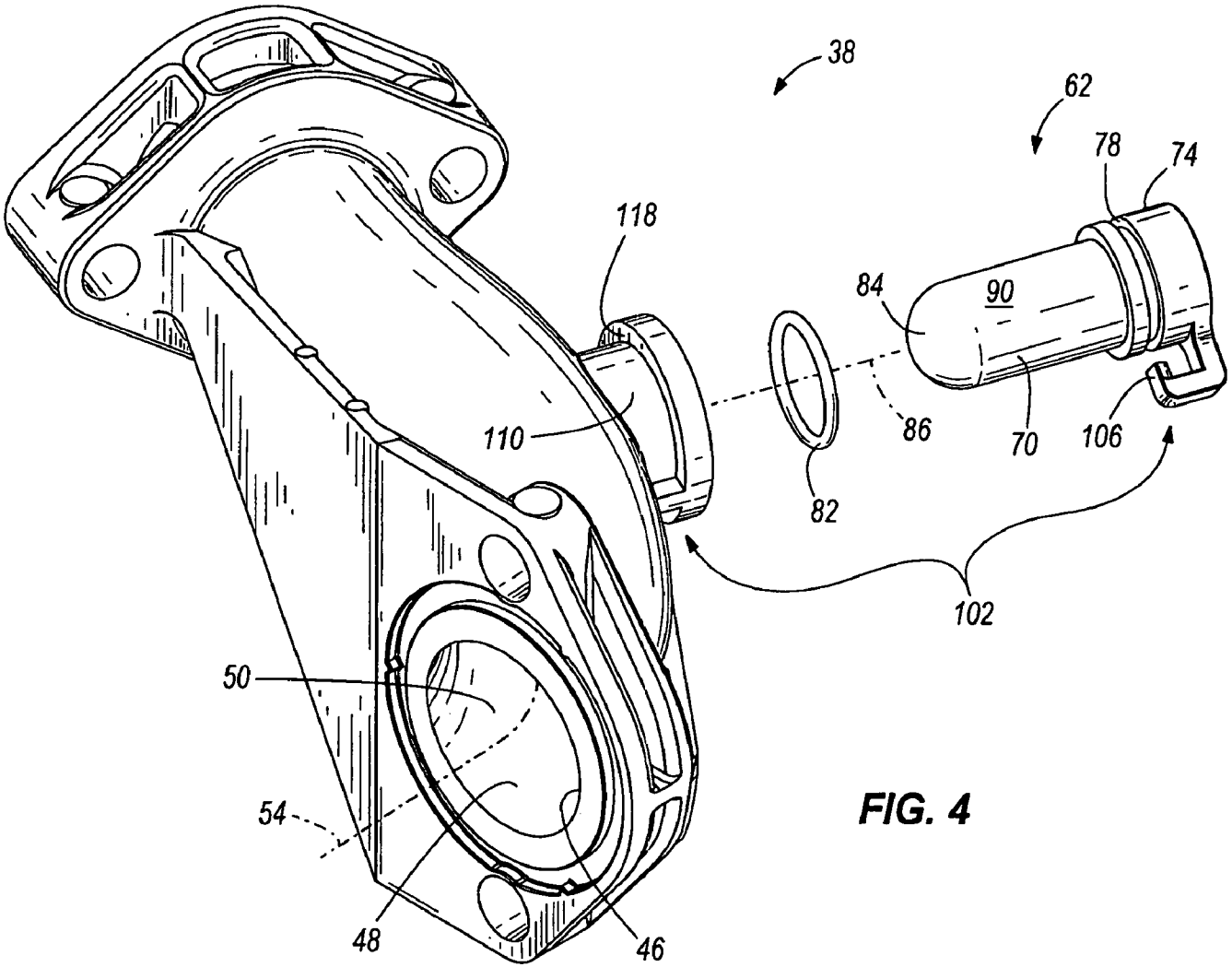
FIG. 4 is an exploded perspective view of the intake manifold and one regulator, chosen from the group or family of differently-sized regulators in FIG. 3.

With reference to FIGS. 3 and 4, the intake manifold 38 includes an inlet 42 configured to receive the fuel/air mixture from the carburetor 34, an outlet 46 configured to discharge the fuel/air mixture into the cylinder head 26, an interior wall 48, and an intake passageway 50 defined by the interior wall 48, through which the fuel/air mixture passes, extending between the inlet 42 and the outlet 46. With additional reference to FIG. 5, the intake passageway 50 has a non-linear longitudinal axis 54, such that the fuel/air mixture passing through the intake passageway 50 travels a substantially arcuate flow path moving from the inlet 42 to the outlet 46. Alternative constructions of the intake manifold 38 may include any of a number of different configurations, in which the longitudinal axis 54 of the intake passageway 50 is substantially arcuate or substantially straight or linear.

With reference to FIG. 3, a family or a group 58 of interchangeable, differently-sized regulators is shown, any of which may be at least partially positioned in an airflow passageway or a fuel/air mixture passageway in the engine 10. In the illustrated construction of the engine 10, any regulator from the group 58 may be coupled to the intake manifold 38. Alternatively, any regulator from the group 58 may be positioned in an airflow passageway in the engine 10 upstream of the carburetor 34. For example, any regulator from the group 58 may be positioned in an airflow passageway in the air cleaner 30, or any regulator from the group 58 may be positioned in an airflow passageway between the air cleaner 30 and the carburetor 34. As such, the term "intake passageway" should not be limited to the passageway through the intake manifold 38, but rather should include any airflow passageway upstream of the carburetor 34, or any fuel/air mixture passageway through the carburetor 34 or downstream of the carburetor 34. Further, rather than selecting a single regulator from the group 58, a combination of two or more regulators from the group 58 (or from other groups of regulators) may be positioned in an airflow passageway in the engine 10 upstream of the carburetor 34 or a fuel/airflow passageway in the engine 10 downstream of the carburetor 34 to achieve a desired decrease in power output by the engine 10.

Figure 2A:
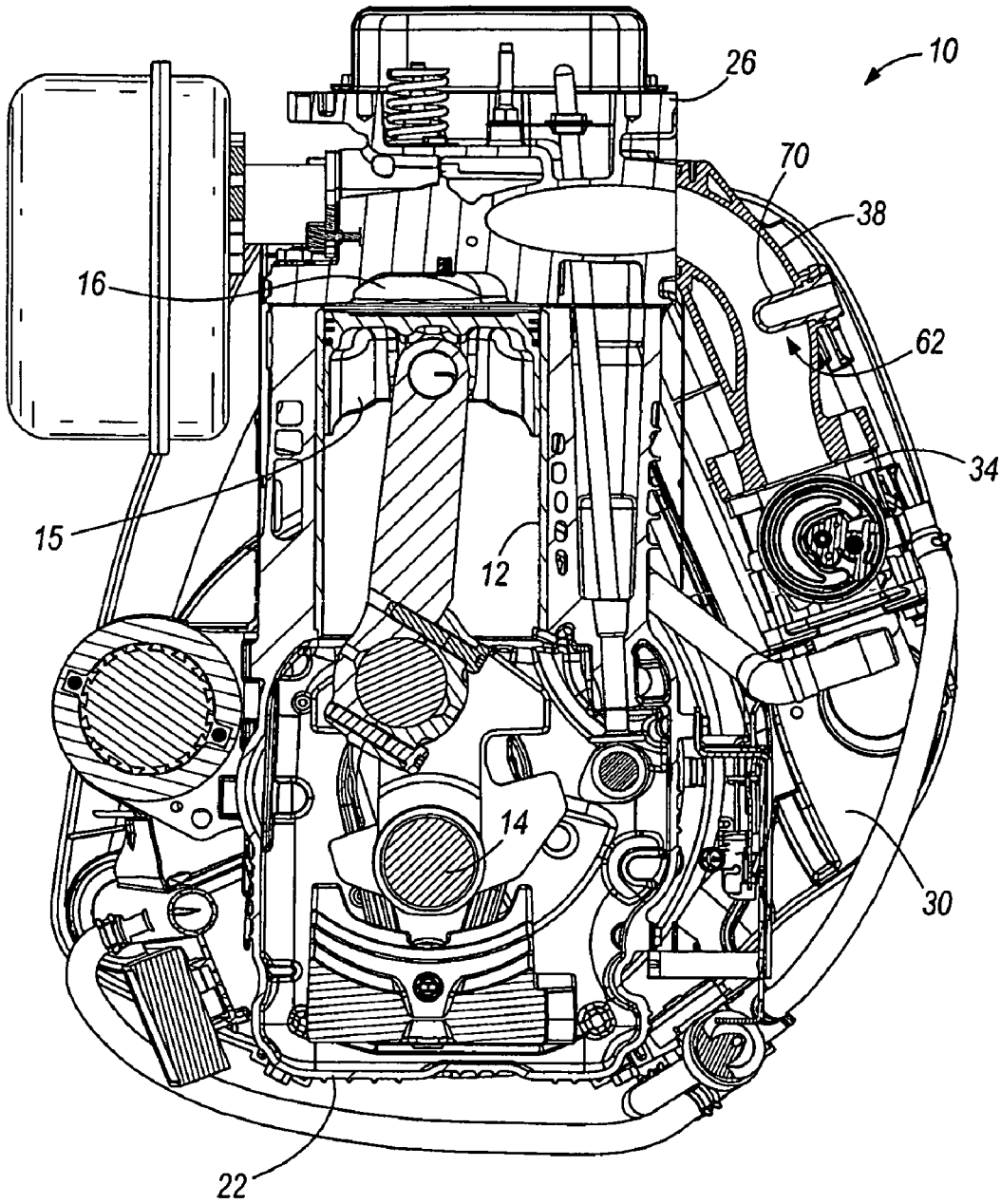
FIG. 2*a* is a partial cross-sectional view of the engine of FIG. 1 through section 2*a*-2*a* in FIG. 1.
Figure 2B:
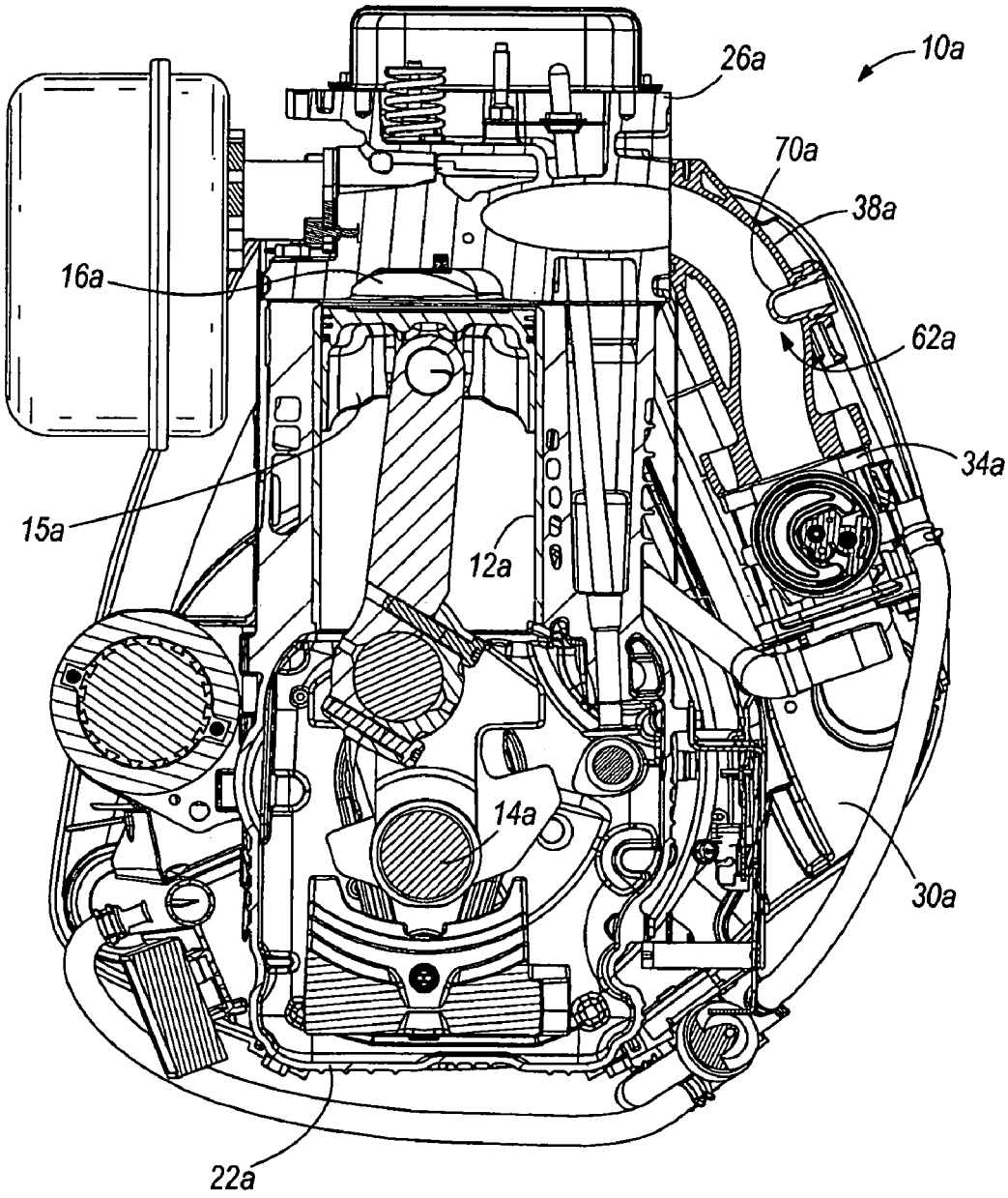
FIG. 2*b* is a partial cross-sectional view similar to FIG. 2*a*, illustrating a second engine having substantially the same configuration of the engine of FIG. 1.

With reference to FIGS. 1 and 2*a*, the engine 10 is shown having one of the regulators 62 from the group 58 coupled to the intake manifold 38. The engine 10, therefore, is operable to achieve a first power output at a selected speed. With reference to FIG. 2*b*, a second engine 10*a* which may have—but need not have—substantially similar internal components as the first engine 10, is shown. Specifically, the second engine 10*a* includes a second cylinder 12*a* that may be substantially similar to the cylinder 12, a second output shaft 14*a* that may be substantially similar to the output shaft 14, a second piston 15*a* that may be substantially similar to the piston 15, a second connecting rod 17*a* that may be substantially similar to the connecting rod 17, a second engine housing 22*a* that may be substantially similar to the engine housing 22, a second cylinder head 26*a* that may be substantially similar to the cylinder head 26, and a second air cleaner 30*a* that may be substantially similar to the air cleaner 30. Second fuel system or carburetor 34*a* is preferably substantially similar to the carburetor 34. Second intake manifold 38*a* may be substantially similar to the intake manifold 38. The second engine 10*a*, however, utilizes a different regulator 62*a* from the group 58 than the engine 10. The engine 10*a*, therefore, is operable to achieve a second power output different from the first power output of the engine 10 at the same selected speed.

As will be discussed in greater detail below, other components of the engine 10*a*, such as the cylinder 12*a*, the output shaft 14*a*, the piston 15*a*, the connecting rod 17*a*, the engine housing 22*a*, the cylinder head 26*a*, the air cleaner 30*a*, the carburetor 34*a*, and the intake manifold 38*a* may be changed, either individually or in combination, to achieve the second or another different power output.

Figure 5:
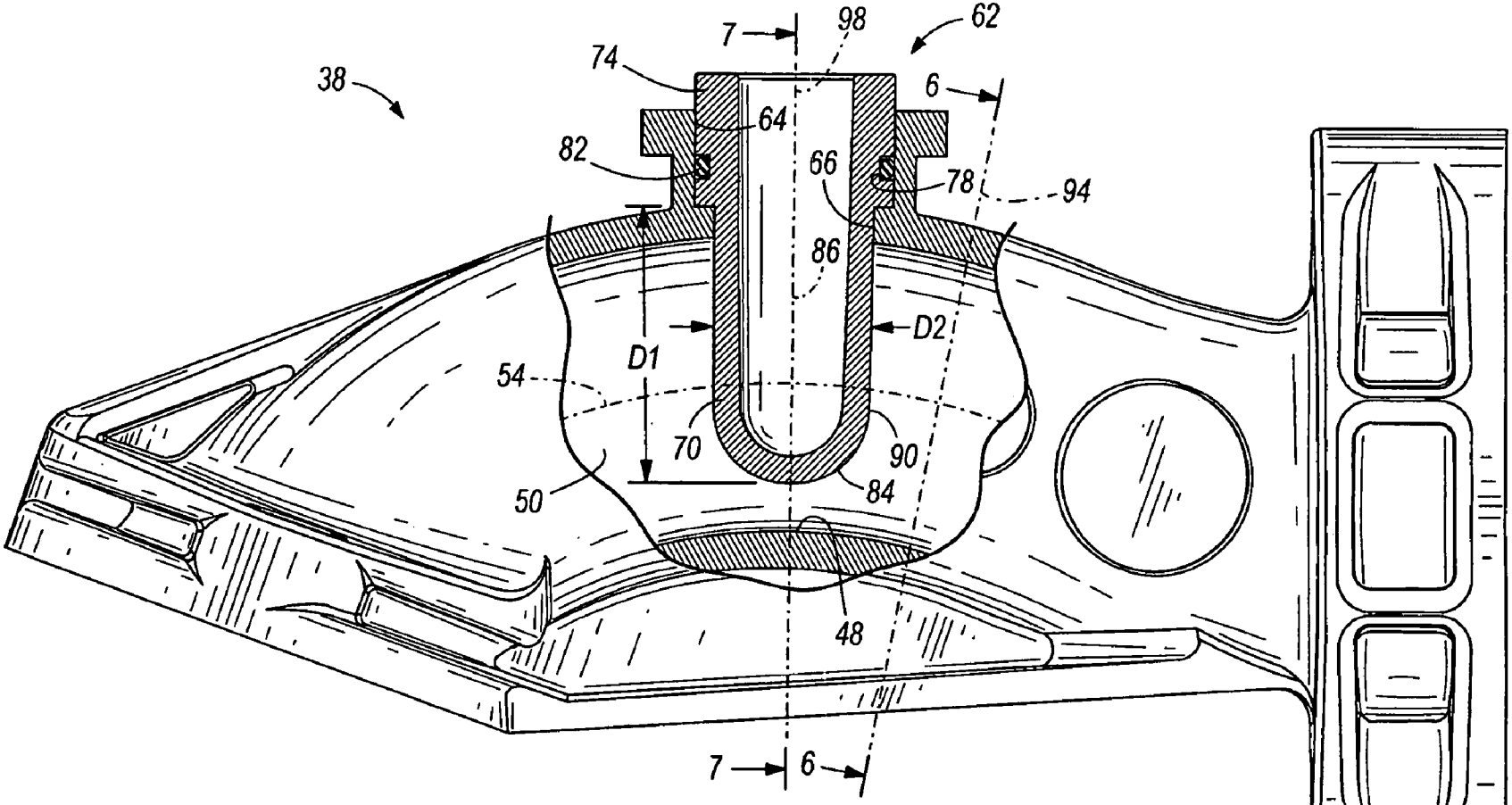
FIG. 5 is an assembled plan view of the intake manifold and regulator of FIG. 4, illustrating a partial cutaway of the intake manifold to expose the regulator positioned in an intake passageway.

With reference to FIG. 3, the intake manifold 38 includes a wall 64 defining an aperture 66, positioned between the inlet 42 and the outlet 46, exposed to the intake passageway 50 for receiving one regulator selected from the group 58 (see also FIG. 5). In the illustrated construction of the intake manifold 38 and group 58 of regulators, the aperture 66 is configured as a stepped aperture 66 for receiving different portions of the regulator. Each of the regulators in the group 58 includes an interior portion (e.g., interior portions 70, 70*a* of regulators 62, 62*a*) that is at least partially positioned within the intake passageway 50, and a base or an exterior portion 74 that is external to the intake passageway 50. As shown in FIG. 5, the exterior portion 74 includes a groove 78 extending around the outer periphery of the exterior portion 74, in which a seal 82 (e.g., an O-ring) is received to seal against the wall 64 to inhibit outside air from leaking into the intake passageway 50 through the aperture 66. Alternative constructions of the intake manifold 38 and the regulators may include stepped or non-stepped apertures and corresponding stepped or non-stepped surfaces on the regulators.

With reference to FIGS. 3 and 4, both the interior portions (e.g., interior portions 70, 70*a*) and the exterior portions 74 of the respective regulators have a generally cylindrical shape. Particularly, the interior portions (e.g., interior portions 70, 70*a*) of the respective regulators are configured as cylinders having a spherical or dome-shaped distal end 84, a longitudinal axis 86, a length dimension D1 along the longitudinal axis 86, and a width dimension D2 transverse to the longitudinal axis 86 (see FIG. 5). Because the interior portions are configured as cylinders having a curved outer surface (e.g., curved outer surface 90 of the regulator 62), the width dimension D2 is equal to the outer diameter of the interior portions 70 (see also FIG. 3).

Alternative constructions of the regulators may include interior portions having any of a number of different shapes. For example, alternative constructions of the regulators may include interior portions, or portions of the regulators exposed to the intake passageway 50, configured as substantially flat plates oriented substantially transversely to the longitudinal axis 54 of the intake passageway 50. In such a configuration, the regulator and/or the intake manifold may include an alignment feature to ensure proper alignment and orientation of the regulator in the intake passageway 50. Also, alternative constructions of the regulators may include substantially conical-shaped interior portions having a longitudinal axis generally aligned with the longitudinal axis 54 of the intake passageway 50. Many other configurations of regulators can be used, because it is the effective regulator surface area exposed (i.e., the portion of the regulator that comes into contact with the airflow or air/fuel mixture) to the airflow compared to the total cross-sectional area of the intake passageway 50, not the shape of the regulator, which primarily determines the change in engine power output.

As shown in FIG. 3, the diameter or the width dimension D2 of each of the interior portions (e.g., interior portions 70, 70*a*) of the respective regulators in the group 58 is substantially equal, while the length dimension D1 (see FIG. 5) of each of the interior portions of the respective regulators in the group 58 is different. Further, each of the exterior portions 74 of the respective regulators in the group 58 is substantially the same size. As such, any one of the regulators in the group 58 may be selected to be received within the stepped aperture 66 because the regulators share commonly-shaped exterior portions 74, and interior portions (e.g., interior portions 70, 70*a*) may have a common width dimension D2 that conform to the shape of the stepped aperture 66. A visual indicator (e.g., a distinctive color, a symbol, etc.) may be utilized on the regulators to differentiate the regulators according to their respective restriction on engine power output.

With reference to FIG. 5, one of the regulators (e.g. the regulator 62) from the group 58 is selected to be received within the stepped aperture 66. The interior portion 70 is oriented within the intake passageway 50 such that the longitudinal axis 86 of the interior portion 70 is substantially transverse to the longitudinal axis 54 of the intake passageway 50. As a result, at least a portion of the air/fuel mixture passing through the intake passageway 50 must pass over the dome-shaped distal end 84 and the curved outer surface 90 of the interior portion 70 of the regulator 62 before being discharged from the outlet 46 of the intake manifold 38.

In other words, the presence of the interior portion 70 of the regulator 62 in the intake passageway 50 effectively decreases the width or height of the intake passageway 50, causing a localized restriction in the flow path of the air/fuel mixture as it passes from the inlet 42 to the outlet 46. The spherical or dome-shaped distal ends 84 allow the regulators, particularly those in the group 58 having the longest length dimensions D1, to be positioned in close proximity to the interior wall 48. By configuring the regulators in the group 58 with the spherical or dome-shaped distal ends 84, as opposed to flat ends with sharp corners that disrupt flow, tighter control of the pressure drop over the interior portions (e.g., interior portions 70, 70*a* of FIG. 3) may be achieved. Tighter control of the power output of the engine (e.g., engines 10, 10 of FIGS. 2*a* and 2*b*, respectively) and more precise control of the power output of the engine may be achieved utilizing the regulators with the spherical or dome-shaped distal ends 84 because of the absence of sharp corners (which can disrupt flow) on the interior portions.

Figure 6:
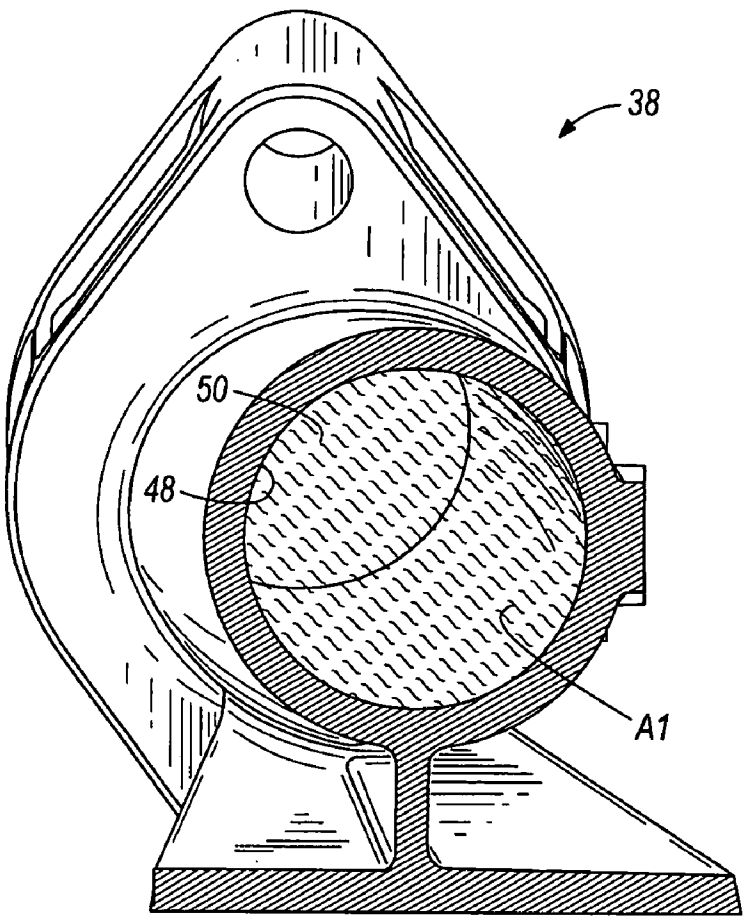
FIG. 6 is a cross-sectional view of the intake manifold of FIG. 5 through section 6-6 in FIG. 5.

With reference to FIG. 6, a cross-section of the intake passageway 50 at a location upstream of the regulator 62 is shown. In the illustrated construction of the intake manifold 38*a*, 38*b*, the intake passageway 50 is configured with a substantially circular cross-sectional shape through a plane 94 positioned upstream of the regulator 62 and oriented substantially transversely to the longitudinal axis 54 of the intake passageway 50. The substantially circular cross-sectional shape of the intake passageway 50 with respect to the plane 94 defines a cross-sectional open area A1. Alternative constructions of the intake manifold 38*a*, 38*b* may include an intake passageway 50 having any of a number of different cross-sectional shapes.

Figure 7:
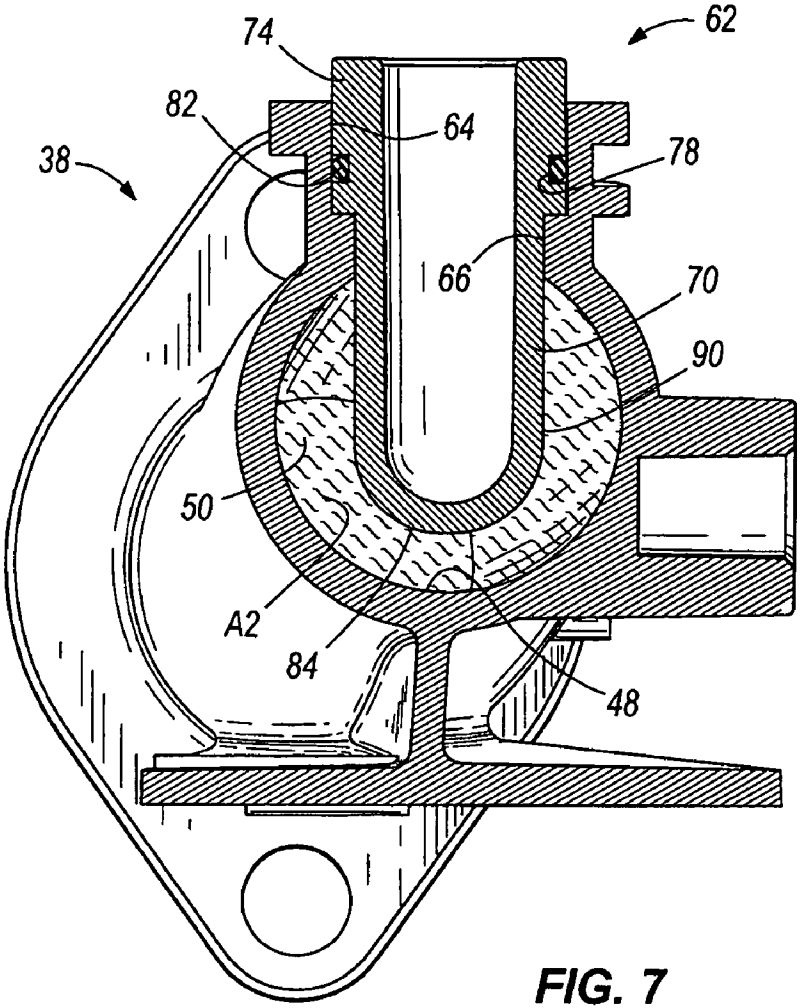
FIG. 7 is a cross-sectional view of the intake manifold and regulator of FIG. 5 through section 7-7 in FIG. 5.

FIG. 7 illustrates a cross-section of the intake passageway 50 and regulator 62, taken through a plane 98 containing the longitudinal axis 86 of the interior portion 70 and oriented substantially transversely to the longitudinal axis 54 of the intake passageway 50. As discussed above, the presence of the interior portion 70 of the regulator 62 in the intake passageway 50 effectively decreases the cross-sectional open area A1 of the intake passageway 50. Specifically, the presence of the interior portion 70 of the regulator 62 in the intake passageway 50 defines a cross-sectional open area A2 substantially less than the cross-sectional open area A1. In one combination of the intake manifold 38 and one of the regulators selected from the group 58, the cross-sectional open area A2 may be no more than about 60 percent of the cross-sectional open area A1. In another combination of the intake manifold 38 and one of the regulators selected from the group 58, the cross-sectional open area A2 may be between about 25 percent and about 85 percent of the cross-sectional open area A1.

With reference to FIGS. 3 and 4, a coupling device 102 may be utilized to secure one of the regulators selected from the group 58 to the intake manifold 38 and maintain the interior portion of the regulator (e.g., the interior portion 70 of the regulator 62) in the intake passageway 50. Particularly, in the construction of the intake manifold 38 and regulators of FIGS. 3 and 4, the coupling device 102 includes a coupler or a finger 106 extending from the exterior portion 74 of the regulator 62 and a groove or slot 110 formed in the intake manifold 38 around the aperture 66 and configured to receive the finger 106. In positioning the regulator 62 in the intake passageway 50, the regulator 62 is oriented such that the finger 106 is aligned with an opening 114 that leads into the slot 110, the regulator 62 is inserted through the aperture 66, and the finger 106 is passed through the opening 114 and into the slot 110. To secure the regulator 62 to the intake manifold 38, the regulator 62 may be rotated about its longitudinal axis 86, causing the finger 106 to move within the slot 110 away from the opening 114. An abutment surface 118 at least partially defining the slot 110, therefore, inhibits the unintentional removal of the regulator 62 from the intake manifold 38 without the required rotation of the regulator 62 to align the finger 106 with the opening 114 in the slot 110.

Figure 8:
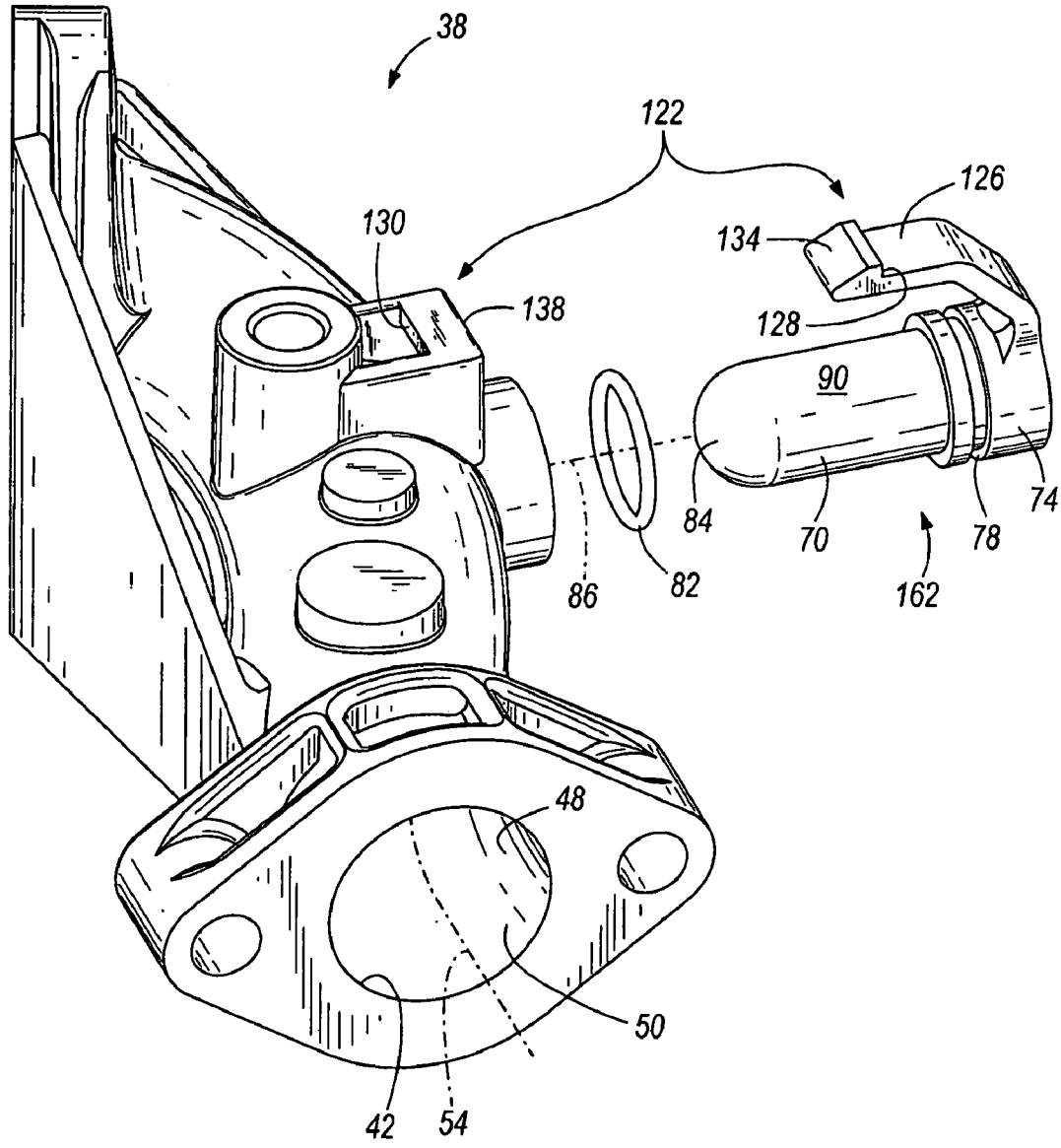
FIG. 8 is an exploded perspective view of a portion of the engine of FIG. 1, illustrating a second construction of an intake manifold and a second construction of one of a group or family of differently-sized intake manifold regulators.

With reference to FIG. 8, another construction of a regulator 162 with another construction of a coupling device 122 is shown, with like features and components having like reference numerals. The coupling device 122 includes a coupler or a resilient tab 126, having an abutment surface 128, extending from the exterior portion 74 of the regulator 162, and an abutment surface 130 on the intake manifold 38 configured to be engaged by the abutment surface 128 of the resilient tab 126 to inhibit unintentional removal of the regulator 162 from the aperture 66. In positioning the regulator 162 in the intake passageway 50, the regulator 162 is oriented such that the resilient tab 126 is aligned with the abutment surface 130 and the regulator 162 is inserted through the aperture 66. To secure the regulator 162 to the intake manifold 38, continued insertion of the regulator 162 causes the resilient tab 126 to deflect by sliding contact between a ramp surface 134 on the resilient tab 126 and an engagement surface 138 on the intake manifold 38. When the regulator 162 is fully inserted into the stepped aperture 66, the resilient tab 126 snaps back to its undeflected shape, such that mutual abutment of the surfaces 128, 130 on the resilient tab 126 and the intake manifold 38 inhibit unintentional removal of the regulator 162 from the intake manifold 38.

Figure 9:
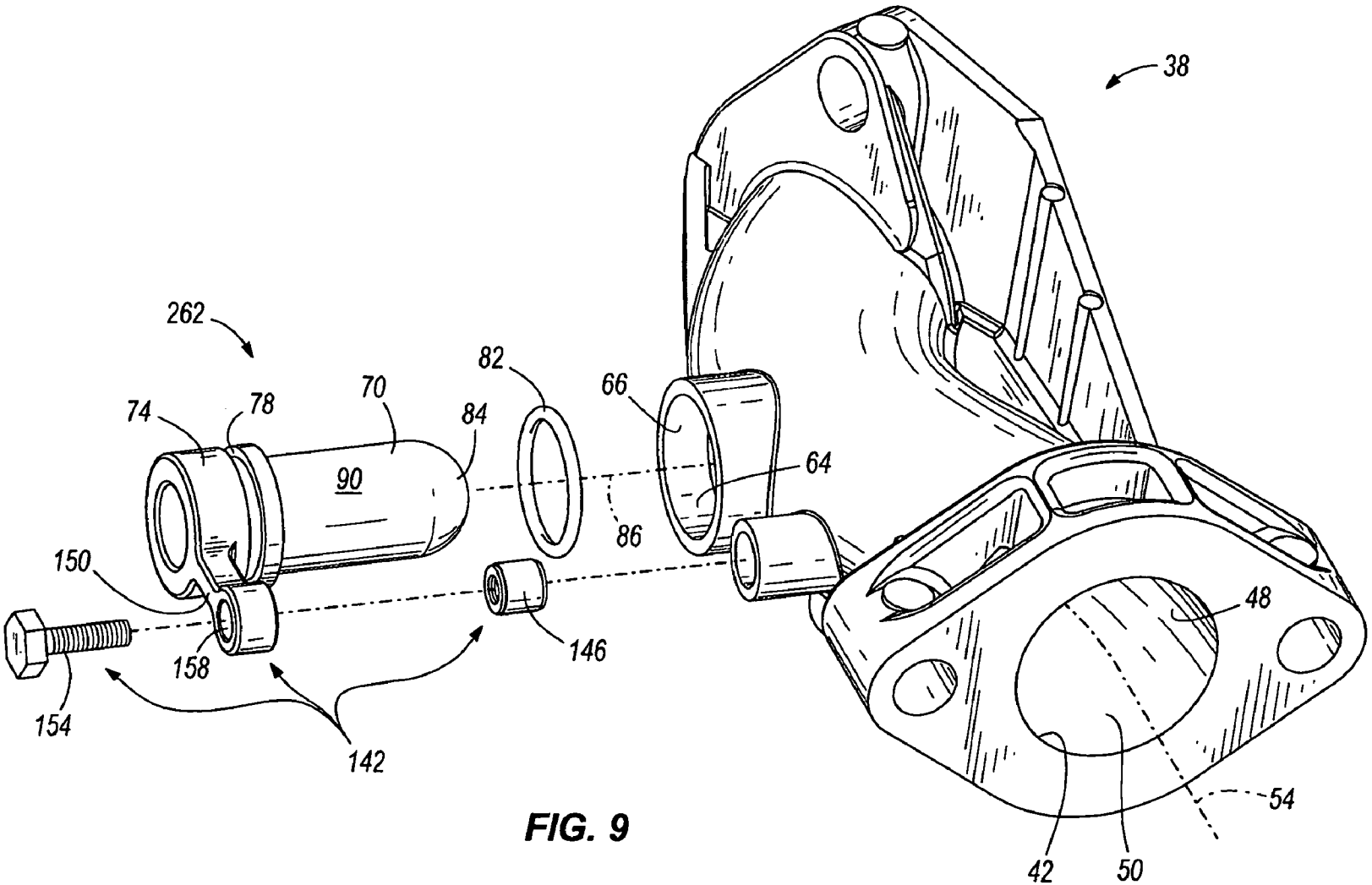
FIG. 9 is an exploded perspective view of a portion of the engine of FIG. 1, illustrating a third construction of an intake manifold and a third construction of one of a group or family of differently-sized intake manifold regulators.

With respect to FIG. 9, yet another construction of a regulator 262 with another construction of a coupling device 142 is shown for securing the regulator 262 to the intake manifold 38, with like features and components having like reference numerals. The coupling device 142 includes an insert 146 coupled to the intake manifold 38, a coupler or a mounting flange 150 extending from the exterior portion 74 of the regulator 262, and a fastener 154 (e.g., a bolt or screw) inserted through an aperture 158 in the mounting flange 150 to threadably engage the insert 146 in the intake manifold 38. Therefore, threading the fastener 154 into the insert 146 to some predetermined torque value inhibits unintentional removal of the regulator 262 from the intake manifold 38. In the illustrated construction of the coupling device 142 in FIG. 9, the insert 146 is molded into the intake manifold 38. In an alternative construction of the coupling device 142, the insert 146 may be omitted such that the fastener 154 is threaded directly into a threaded aperture or bore in the intake manifold 38.

Alternatively, the coupling devices 102, 122, 142 may be omitted, and an interference fit between the exterior portion 74 and/or the interior portion 70 of the regulator 62, 162, or 262 and the stepped aperture 66 may be utilized to maintain the interior portion 70 of the regulator 62, 162, or 262 in the intake passageway 50. As a further alternative, the O-ring 82 may provide the interference fit with the stepped aperture 66, such that the coupling devices 102, 122, 142 may be omitted.

Figure 10:
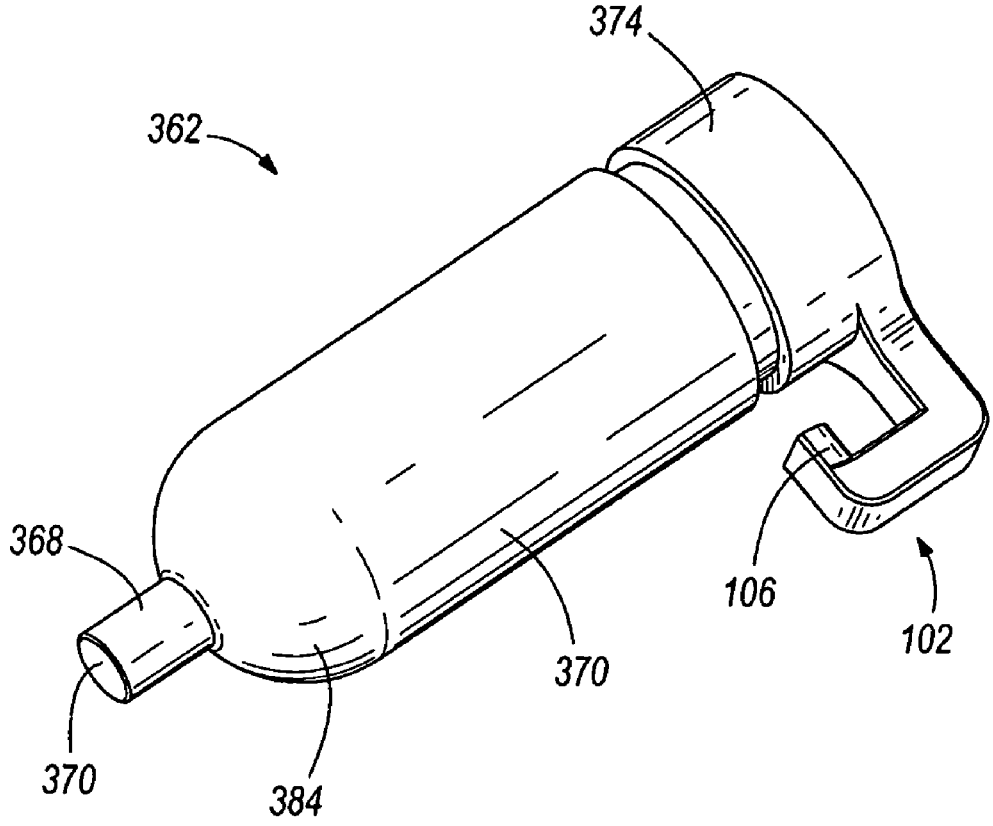
FIG. 10 is a perspective view of a fourth construction of one of a group or family of differently-sized intake manifold regulators.
Figure 11:
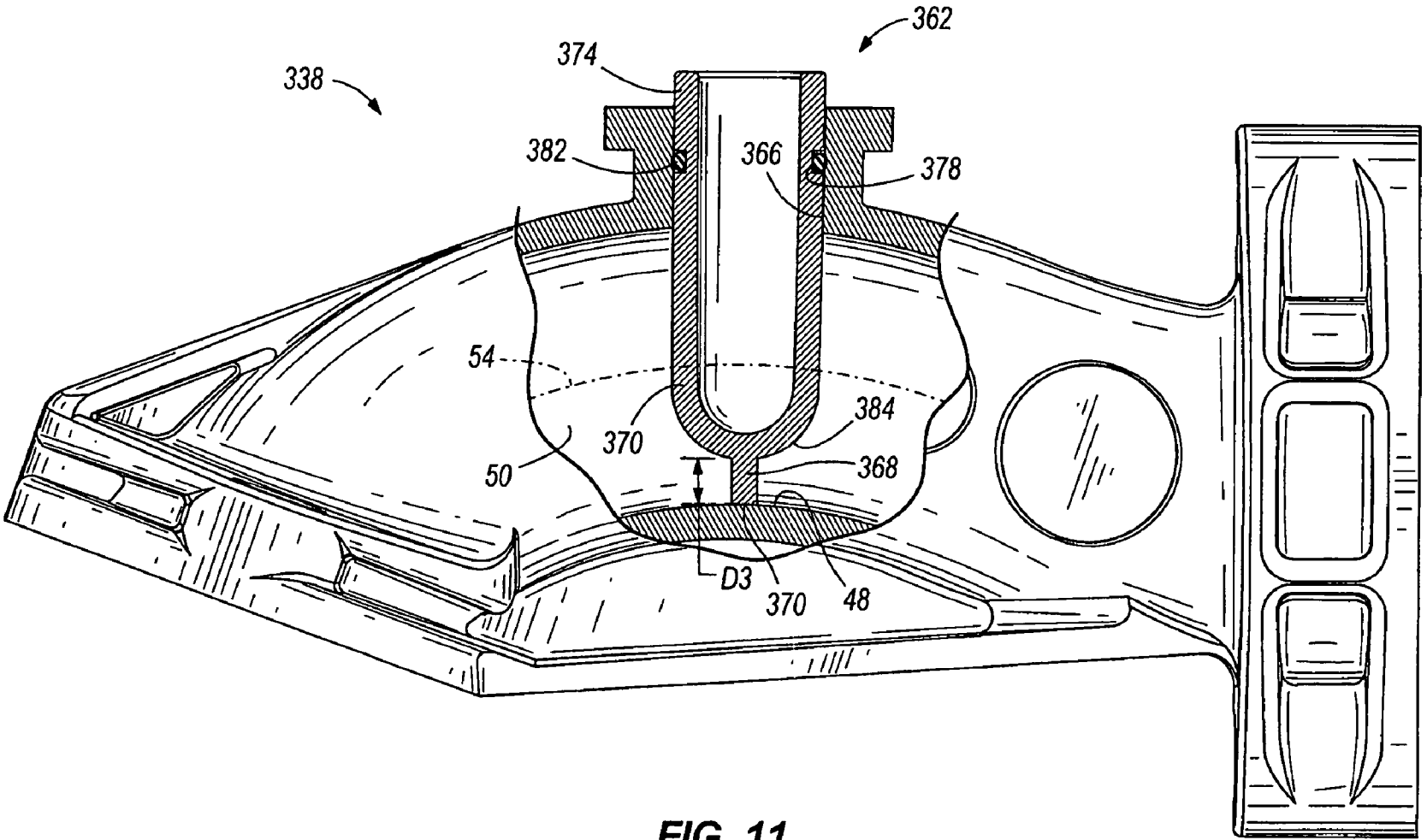
FIG. 11 is an assembled view of the regulator of FIG. 10 and a fourth construction of an intake manifold, illustrating a partial cutaway of the intake manifold to expose the regulator positioned in an intake passageway of the intake manifold.

With reference to FIGS. 10 and 11, another construction of an intake manifold 338 and a regulator 362 is shown. The intake manifold 338 is similar to the intake manifold 38 of FIGS. 3-7, with like features having like reference numerals. The regulator 362 includes an interior portion 370 that is at least partially positioned within the intake passageway 50, and an exterior portion 374 that is external to the intake passageway 50. The exterior portion 374 includes a groove 378 extending around the outer periphery of the exterior portion 374, in which a seal 382 (e.g., an O-ring, see FIG. 11) is received to seal against a wall 364 of the intake manifold 338 to inhibit outside air from leaking into the intake passageway 50 through a non-stepped aperture 366 defined by the wall 364. The groove 378 and seal 382 also separates the interior portion 370 from the exterior portion 374 of the regulator 362. Although the regulator 362 is illustrated with a portion of the coupling device 102 (i.e., the finger 106), the regulator 362 may be configured to utilize any of the coupling devices 122, 142 illustrated in FIGS. 8 and 9, respectively.

With continued reference to FIGS. 10 and 11, the regulator 362 includes an axial locating post 368 extending from a spherical or dome-shaped end 384 of the interior portion 370. The post 368 includes a substantially flat distal end 370 that is engageable with the interior wall 48 of the intake manifold 338 (see FIG. 11). The post 368 has a length dimension D3 that, when the regulator 362 is inserted through the aperture 366, determines how much of the interior portion 370 is exposed to the air/fuel mixture in the intake passageway 50. Like the family or group 58 of regulators illustrated in FIG. 3, the regulator 362 may be one of a family or group of regulators having axial locating posts of different length dimensions D3 to provide different amounts of restriction within the intake passageway 50.

By providing the axial locating post 368, rather than a combination of differently-sized bases or exterior portions (e.g., exterior portions 74 in FIG. 3) and interior portions (e.g., interior portions 70, 70*a* in FIG. 3), the tolerance stack-up of the resulting open area at the restriction may be reduced. In other words, the tolerance of the open area (e.g., open area A2 of FIG. 7) is affected by a single value—the tolerance of the length dimension D3 of the axial locating post 368—rather than multiple values (e.g., the length dimension D1 of the interior portion 70 in FIG. 5, the counter-bore depth of the stepped aperture 66 in FIG. 5, and the location of the shoulder between the interior and exterior portions 70, 74 in FIG. 5). As a result, tighter and more precise control of the power output of the engine (e.g., the engines 10, 10*a* of FIGS. 2*a* and 2*b*, respectively) may be achieved.

With reference to FIG. 3, the regulators in the family or group 58 may be sized to decrease the net horsepower of the unrestricted engine 10 between about 5 percent and about 25 percent or more. Such a reduction in the power output of the engine 10 is a function of the exposed area (i.e., the portion of the regulator 62 that comes into contact with the airflow or fuel/air mixture) of the regulator 62 in the intake passageway 50—i.e., as the length dimension D1 increases, the cross-sectional open area A2 (see FIG. 7) decreases, thus restricting the amount of fuel/air mixture that can be effectively consumed by the engine 10 during operation. Such a reduction in power output may be achieved without any modifications to the calibration of the carburetor 34 or other fuel system, and without replacing the carburetor or other fuel system. In other words, no changes in the amount of fuel metered to the airflow by the carburetor 34 would be necessary to achieve the resultant decreases in power output for each engine-regulator combination.

With reference to FIG. 3, one regulator from the group 58 may be selected to achieve a power output of the engine 10 that is less than the unrestricted power output of the engine 10. In deciding which of the regulators in the group 58 to select, the unrestricted power output of the engine 10 is determined, and a desired or a restricted power output is determined. Then, knowing the horsepower drop caused by each of the regulators in the group 58 from empirical testing performed on an engine having the same configuration as the engine 10, a particular regulator may be selected to achieve the desired power output of the engine 10, without altering or changing the fuel calibration of the carburetor 34 and without changing the engine castings. It is also desirable to use the same configuration of the engine housing 22. While the same configurations of pistons 15, connecting rods 17, crankshafts 14, and the valve train may also be used, different configurations of the pistons, connecting rods, crankshafts, and the valve train may alternatively be used to achieve a greater number of variations of power output for the engine 10.

Another method or process of using the family or group 58 of regulators with the engine 10 includes measuring the power output of the engine 10 using a first regulator from the group 58. If the measured power output of the restricted engine 10 does not match a desired power output, then the first regulator may be removed from the intake manifold 38 without disassembling the engine 10 or removing the intake manifold 38 from the cylinder head 26 or the carburetor 34. A second regulator from the group 58 may then be chosen to replace the first regulator in the intake manifold 38. This method or process of using the group 58 of regulators reduces the repair time or the rebuild time necessary for changing the power output of the engine 10. Rather than changing internal components of the engine 10 (e.g., the crankshaft 14, the piston 15, the connecting rod 17, the valve train, the camshaft, the cylinder head 26, etc.) to change the power output of the engine 10, which often requires a relatively large amount of time, the existing regulator in the engine 10 may be replaced with another regulator from the group 58 to change the power output of the engine 10.

As used herein, "disassembly of the intake passageway" includes removing or disconnecting any component forming a portion of the intake passageway, including the carburetor 34 and the intake manifold 38. In other words, the first regulator may be removed and replaced by the second regulator merely by disconnecting the coupling device 102, 122, or 142, removing the first regulator from the aperture 66 along the longitudinal axis 86 of the first regulator, inserting the second regulator into the aperture 66 along the longitudinal axis 86 of the second regulator, and re-connecting the coupling device 102, 122, or 142. These steps to exchange the first regulator for the second regulator may occur without removing or disconnecting the carburetor 34 or the intake manifold 38, for example, from the engine 10.

These processes may be used to manufacture engines 10, each having a distinct desired power output, selectable from a range of power outputs available from installing one of the regulators in the group 58, from a common engine configuration utilizing the intake manifold 38 and the same fuel calibration in the carburetor 34. For example, first and second production runs of engines 10, including substantially identical engine housings 22, output shafts 14, cylinders 12, pistons 15, combustion chambers 16, carburetors 34, and intake manifolds 38, may yield a first power output at a selected speed and a second power output (different than the first power output) at the selected speed, respectively, due to the differently-sized regulators chosen for the first and second production runs of engines 10. Also, an existing production run of engines 10 incorporating one of the regulators from the group 58 may be re-worked to remove the existing regulators from the engines 10, which allowed the engines 10 to generate the first power output at the selected speed, and replace them with differently-sized regulators, which would allow the engines 10 to generate the second power output at the selected speed. In embodiments of the regulators utilizing visual indicators (e.g., distinctive colors, symbols, etc.) on the regulators in the group 58 to distinguish between the first and second regulators, the visual indicators may facilitate identification of the regulators on an assembly line during a production run or during re-work (i.e., repairing or rebuilding) of already-assembled engines so that the correct regulator is coupled to the engine. Therefore, costs relating to tooling, assembly line set-up changes, down time, and re-work of already-assembled engines to change-out crankshafts, camshafts, pistons, connecting rods, cylinder heads, or carburetors to change the power output of the engines may be reduced.

FIGS. 12-15 depict another construction of the present invention. Referring to FIGS. 12-15, intake manifold assembly 438 includes a main body 439 having an inlet 442 and an outlet 443. Body 439 includes an intake passageway 450 defined by a wall 448.

Intake assembly manifold assembly 438 also includes a regulator 462 that is disposed in a slot or aperture 466 (See FIG. 13) formed within wall 464. In this construction, regulator 462 has a substantially planar outer surface 463 as part of its exterior portion 474, and an interior portion 470 having a fluid flow aperture 471 therein. Interior portion 470 is configured as a plate-like member in the depicted embodiment, although other constructions could be used.

Figure 12:
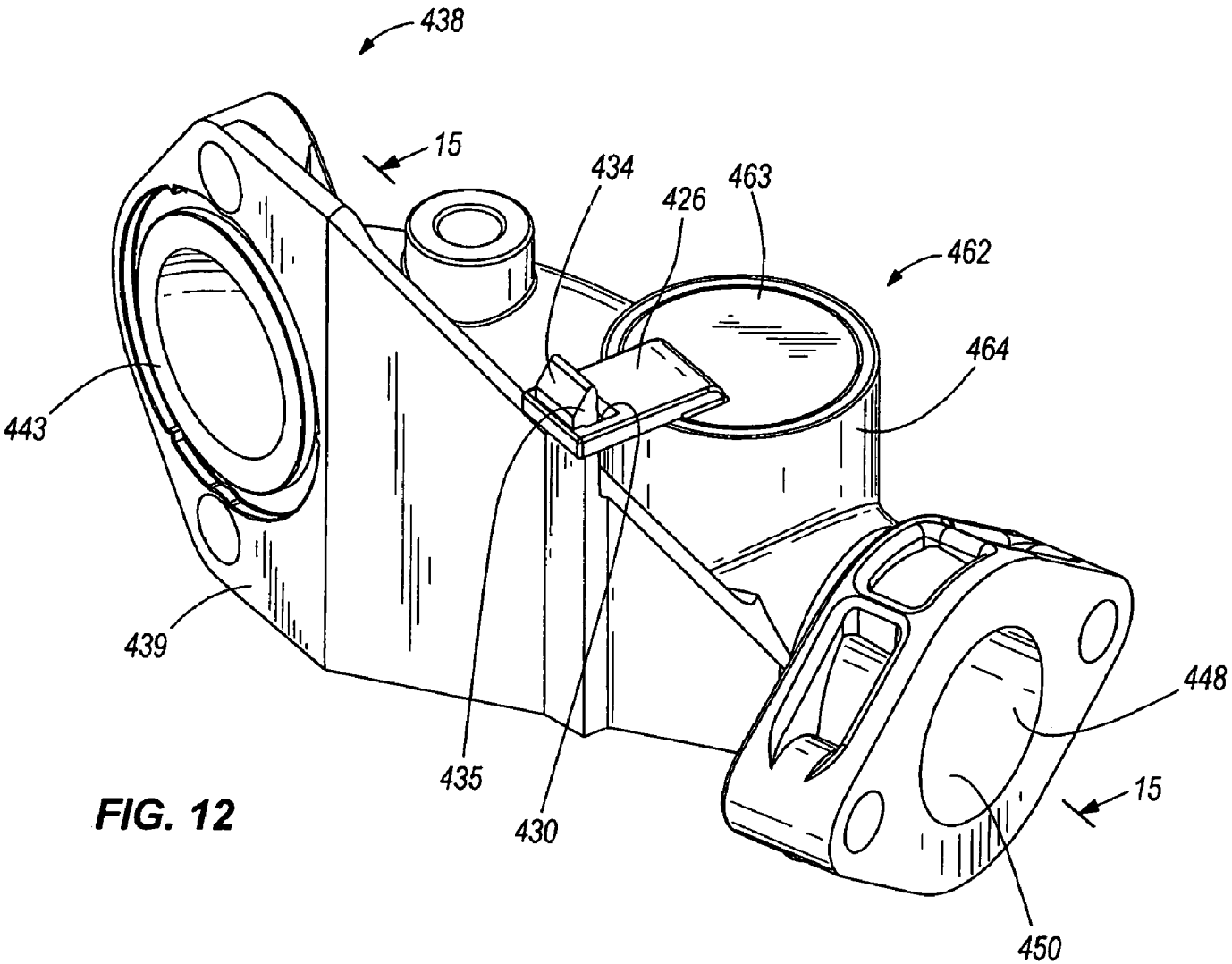
FIG. 12 is a perspective view of a fifth construction of an intake manifold assembly according to the present invention.
Figure 13:
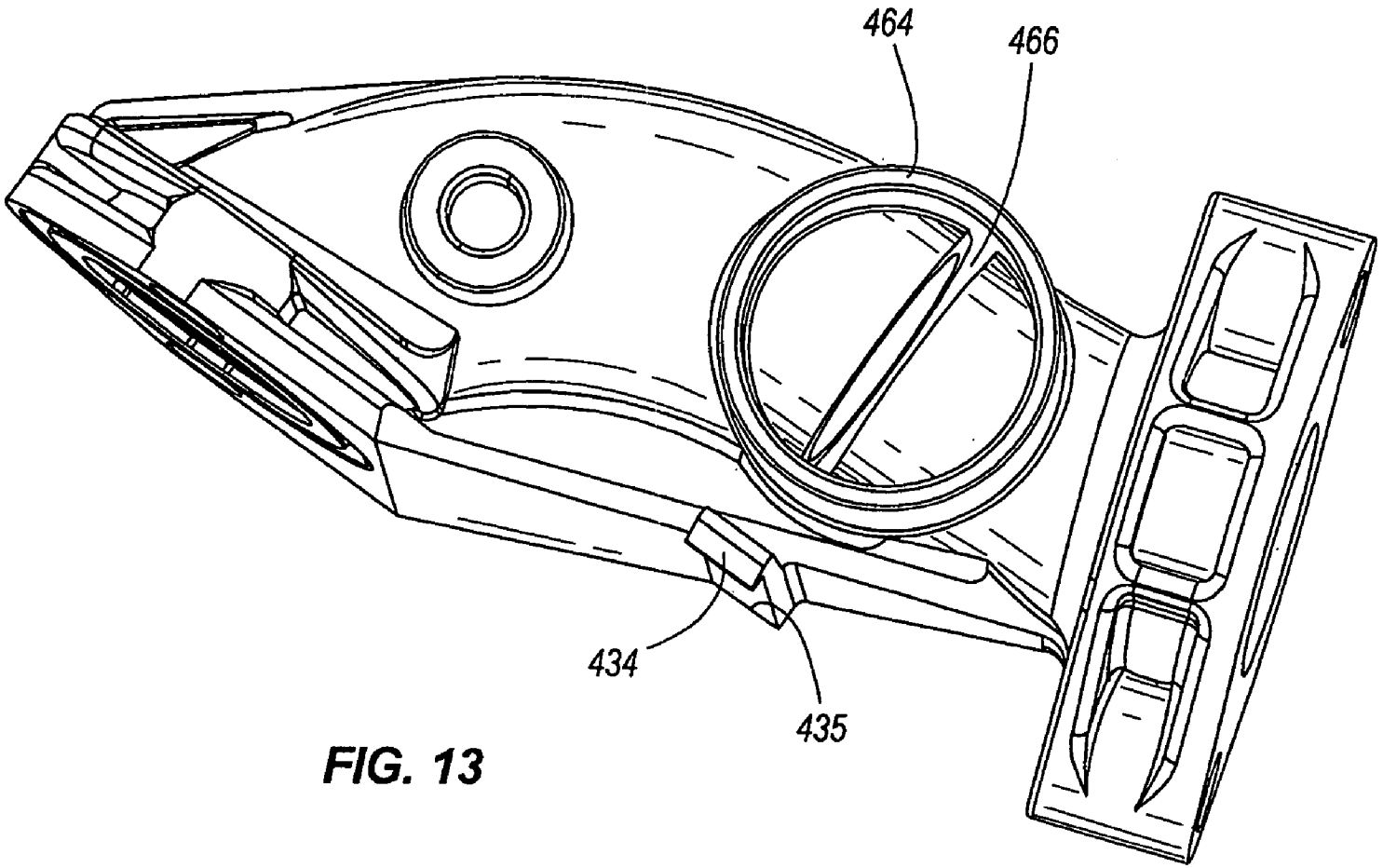
FIG. 13 is a top view of the intake manifold used in the fifth construction.
Figure 14:
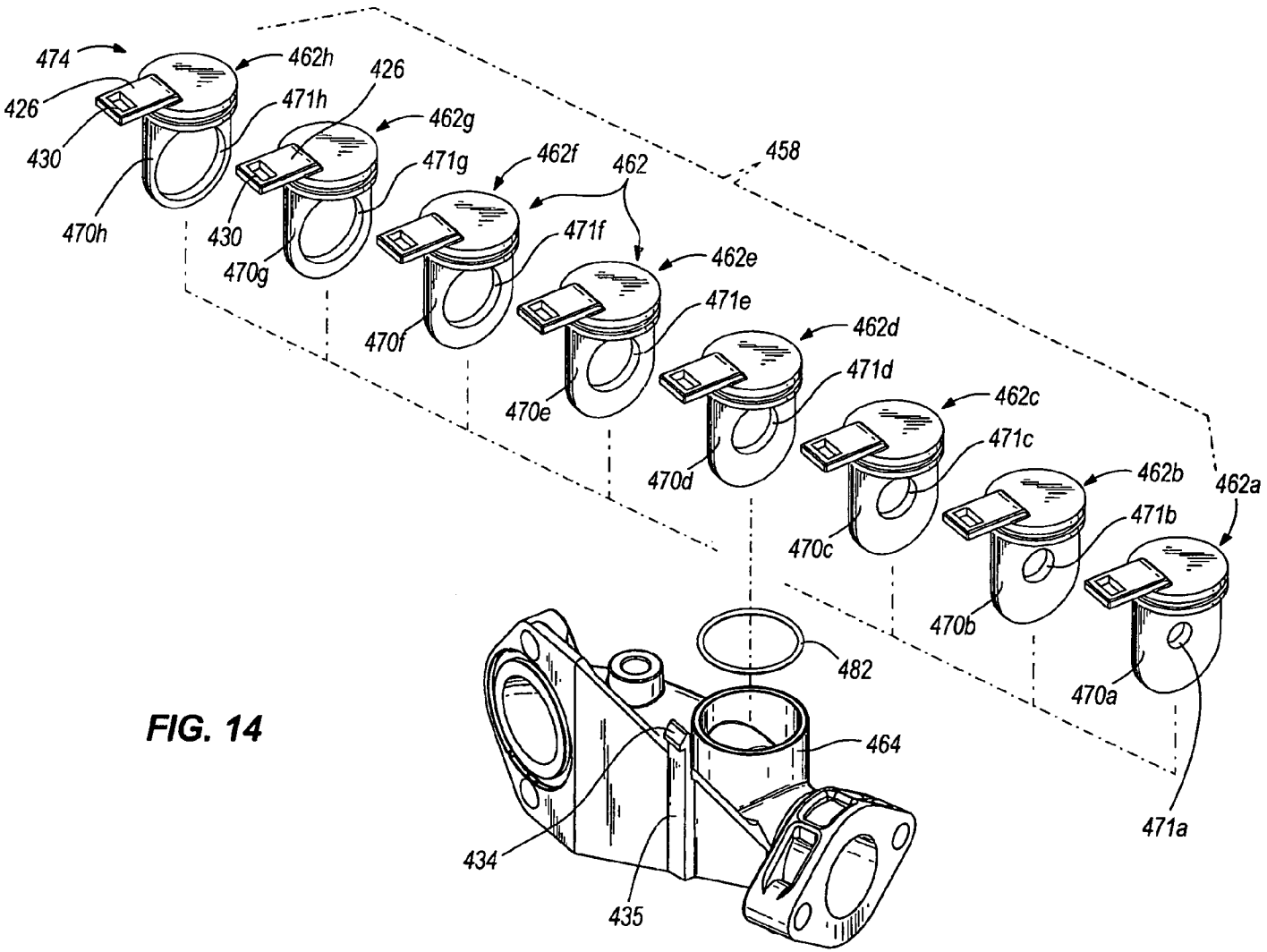
FIG. 14 is an exploded perspective view of the fifth construction, and illustrates a group or family of differently-sized intake manifold regulators used in the fifth construction.
Figure 15:
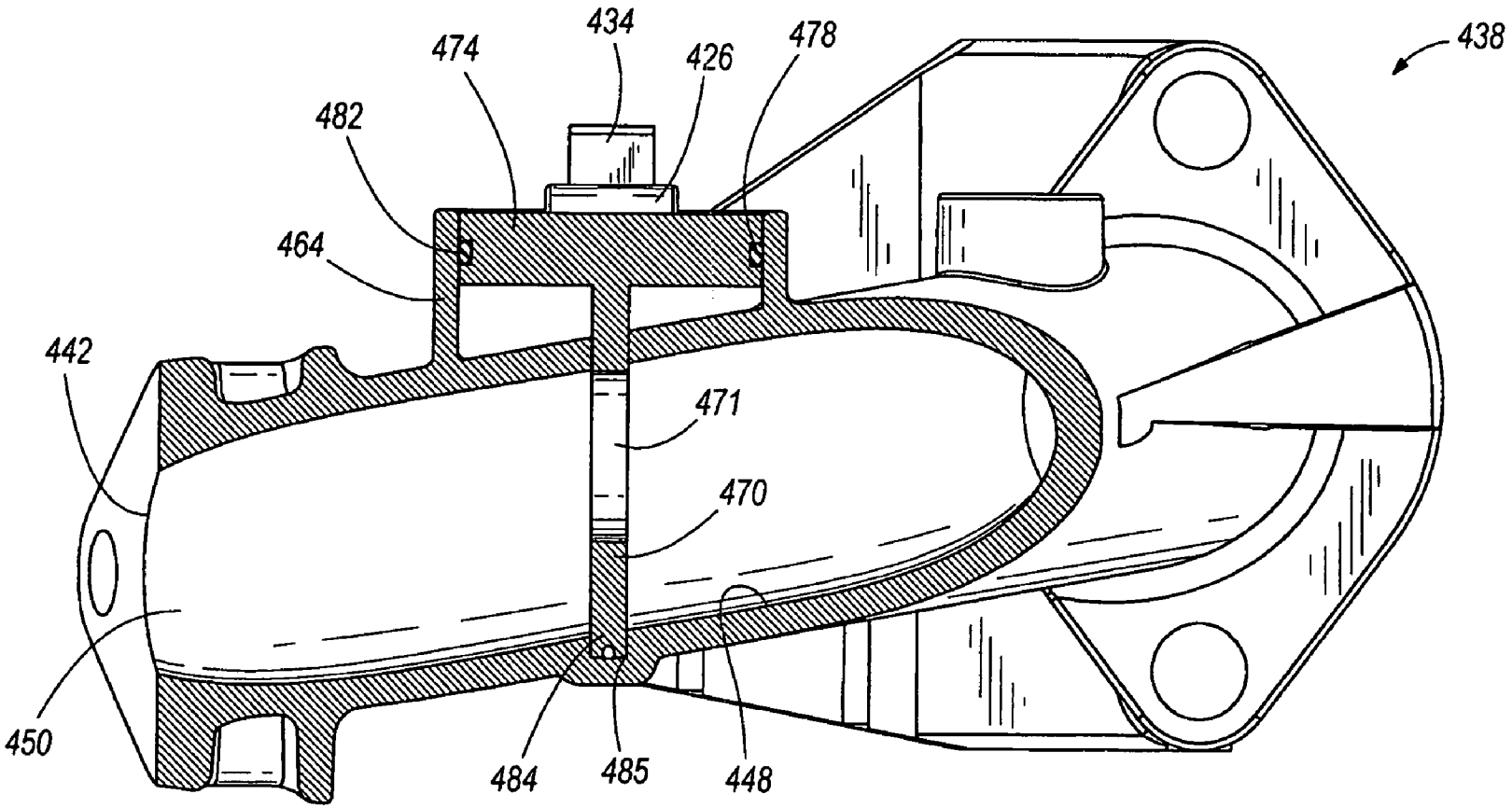
FIG. 15 is a side cross sectional view of the fifth construction, taken along line 15-15 of FIG. 12.

As best shown in FIGS. 12 and 15, regulator 462 is retained by a coupling device that interconnects the exterior portion 474 of the regulator 462 to the intake manifold body 439. The coupling device includes a post 435 having a ramped surface 434 attached to body 439. Post 435 receives an aperture 430 of a resilient tab 426 that extends from exterior portion 474, and more particularly from outer surface 463 of regulator 462. As best shown in FIGS. 14 and 15, a seal 482 (such as an O-ring) is received in a groove 478 formed in the end or exterior portion 474 of regulator 462.

The regulator 462 is retained in place by having its end 484 disposed within a slot or recess 485, which in turn is formed in intake manifold body 439. See FIG. 15. This configuration reduces the tolerance stack-up issues discussed above in connection with the construction of FIGS. 8-11.

FIG. 14 depicts a group or family 458 of regulators, each designed to achieve a different horsepower for the engine by varying the size of the effective fluid flow aperture 471 in the interior portion 470. The larger the size of the aperture, the less restriction there is to fluid flow through intake passageway 450. Conversely, the smaller the size of the aperture 471, the greater the surface area of the solid portion of interior portions 470, and consequently the greater the restriction to fluid flow through the intake passageway 450.

Although reference is made to a fluid flow aperture as part of the interior portion, it is apparent that the aperture as shown is more accurately depicted as a cylinder in that it has a length in the direction of fluid flow. Of course, non-cylindrical apertures could also be used, such as conical or polygonal shaped-openings; in general, it is the total amount of restriction to fluid flow which determines the amount of regulation, not the particular shape or configuration of the aperture.

Referring again to FIG. 14, the group or family of regulators 462 is comprised of regulators 462*a* through 462*h*. Each of these regulators 462*a* through 462*h* has respective interior portions 470*a* through 470*h*. Each of the interior portions has formed therein a respective aperture 471*a* through 471*h*. Each of the apertures 471*a* through 471*h* has a different size, as clearly shown in FIG. 14. Thus, each of the regulators 462*a* through 463*h* results in a different horsepower for the engine.

Various features of the invention are set forth in the following claims.

What is claimed is:

1. An engine system configured to provide a plurality of engines having different power outputs at the same selected speed, the engine system comprising:

a first engine having a first power output at the selected speed, the first engine including a first engine housing;

a first crankshaft rotatably supported in the first engine housing;

a first cylinder;

a first piston movable within the first cylinder;

a first combustion chamber in fluid communication with the first cylinder;

a first carburetor configured to provide fuel to the first combustion chamber;

a first intake manifold including an interior wall at least partially defining a first passageway between the first carburetor and the first combustion chamber, the first passageway configured to deliver an air/fuel mixture to the first combustion chamber, the first passageway having a first cross-sectional open area, the first intake manifold formed as a single piece;

a first aperture in the interior wall of the first intake manifold;

a first regulator received in the first aperture and at least partially positioned in the first passageway to effectively decrease the first cross-sectional open area of the first passageway, the first regulator selected such that the first engine operates at the first power output at the selected speed;

a first coupling device configured to maintain the first regulator in the first passageway, and configured to enable removal of the first regulator without disassembly of the first passageway;

a second engine having a second power output at the selected speed that is different from the first power output, the second engine including a second engine housing;

a second crankshaft rotatably supported in the second engine housing;

a second cylinder;

a second piston movable within the second cylinder;

a second combustion chamber in fluid communication with the second cylinder;

a second carburetor configured to provide fuel to the second combustion chamber;

a second intake manifold including an interior wall at least partially defining a second passageway between the second carburetor and the second combustion chamber, the second passageway configured to deliver an air/fuel mixture to the second combustion chamber, the second passageway having a second cross-sectional open area, the second intake manifold formed as a single piece;

a second aperture in the interior wall of the second intake manifold;

a second regulator received in the second aperture and at least partially positioned in the second passageway to effectively decrease the second cross-sectional open area of the second passageway, the second regulator selected such that the second engine operates at the second power output at the selected speed; and a second coupling device configured to maintain the second regulator in the second passageway, and configured to enable removal of the second regulator without disassembly of the second passageway.

2. The engine system of claim 1, wherein the first and second carburetors are substantially identical.

3. The engine system of claim 2, wherein the first and second carburetors have similar calibrations.

4. The engine system of claim 1, wherein the first and second engine housings are substantially identical.

5. The engine system of claim 1, wherein the first and second crankshafts are substantially identical.

6. The engine system of claim 1, wherein the first and second pistons are substantially identical.

7. The engine system of claim 1, wherein the first and second combustion chambers are substantially identical.

8. The engine system of claim 1, wherein the first and second passageways are substantially identical.

9. The engine system of claim 1, wherein the first and second coupling devices are substantially identical.

10. The engine system of claim 1, wherein said first regulator has a cylindrical portion.

11. The engine system of claim 10, wherein said first regulator has a dome-shaped end.

12. The engine system of claim 11, wherein said first regulator further comprises a post extending from said dome-shaped end.

13. The engine system of claim 1, wherein the first regulator includes an aperture configured to permit the air/fuel mixture in the first passageway to pass therethrough.

14. The engine system of claim 13, wherein the first regulator comprises a plate having the aperture therein.

15. The engine system of claim 13, wherein the aperture in the first regulator is a first aperture, and wherein the second regulator includes a second aperture, different in size from said first aperture, and configured to permit the air/fuel mixture in the first passageway to pass therethrough.

16. The engine system of claim 15, wherein the second regulator comprises a second plate having the second aperture therein.

17. An internal combustion engine comprising:

an engine housing;

a crankshaft rotatably supported in the engine housing;

a cylinder;

a piston movable within the cylinder;

a combustion chamber in fluid communication with the cylinder;

a carburetor configured to provide fuel to the combustion chamber;

an intake manifold including an interior wall at least partially defining an intake passageway between the carburetor and the combustion chamber, the passageway configured to deliver an air/fuel mixture to the combustion chamber, the intake passageway having a cross-sectional open area, the intake manifold formed as a single piece;

an aperture in the interior wall;

a first regulator received in the aperture and at least partially positioned in the intake passageway to effectively decrease the cross-sectional open area of the intake passageway, the first regulator selectable from a plurality of regulators; and a coupling device configured to maintain the first regulator in the intake passageway;

wherein the first regulator is configured to be removed and replaced by a second regulator from the plurality of regulators without disassembly of the intake passageway.

18. The engine of claim 17, wherein the cross-sectional open area of the intake passageway is a first cross-sectional open area defined in a first plane located upstream of the first regulator, the first plane oriented substantially transversely to a longitudinal axis of the intake passageway, wherein the intake passageway has a second cross-sectional open area defined in a second plane containing a longitudinal axis of the first regulator, the second plane oriented substantially transversely to the longitudinal axis of the intake passageway, and wherein the second cross-sectional open area is no more than about 60 percent of the first cross-sectional open area.

19. The engine of claim 18, wherein the second cross-sectional open area is between about 25 percent and about 85 percent of the first cross-sectional open area.

20. The engine of claim 17, wherein the portion of the first regulator in the intake passageway includes a curved surface.

21. The engine of claim 17, wherein the coupling device includes a fastener coupling the first regulator to the engine.

22. The engine of claim 17, wherein the coupling device includes a resilient tab coupled to one of the first regulator and the engine, and an abutment surface coupled to the other of the first regulator and the engine, and wherein the first regulator is configured to be maintained within the intake passageway when the resilient tab is engaged with the abutment surface.

23. The engine of claim 17, wherein the coupling device includes a finger coupled to one of the first regulator and the engine, and a slot formed in the other of the first regulator and the engine, and wherein the first regulator is configured to be maintained within the intake passageway when the finger is positioned in the slot.

24. The engine of claim 17, wherein the engine is configured such that the carburetor and a calibration of the carburetor do not require changes when the first regulator is removed and replaced by the second regulator.

25. The engine of claim 17, wherein the intake passageway has a longitudinal axis, and wherein the first regulator has a longitudinal axis oriented substantially transversely to the longitudinal axis of the intake passageway.

26. The engine of claim 17, wherein said first regulator has a cylindrical portion configured to extend into said intake passageway.

27. The engine of claim 26, wherein said cylindrical portion has a dome-shaped end.

28. The engine of claim 27, wherein said first regulator further comprises a post extending from said dome-shaped end.

29. The engine system of claim 17, wherein the first regulator includes an aperture configured to permit the air/fuel mixture in the intake passageway to pass therethrough.

30. The engine system of claim 29, wherein the first regulator comprises a plate having the aperture therein.

31. The engine system of claim 29, wherein the aperture in the first regulator is a first aperture, and wherein the second regulator includes a second aperture, different in size from said first aperture, and configured to permit the air/fuel mixture in the intake passageway to pass therethrough.

32. The engine system of claim 31, wherein the second regulator comprises a second plate having the second aperture therein.

* * * * *